United States Patent [19]

Koft, Jr.

[11] 4,016,093

[45] Apr. 5, 1977

[54] METAL ALKYLPHENATE SULFIDES OF REDUCED CORROSIVENESS AND METHOD OF PREPARING SAME

[75] Inventor: Emil Koft, Jr., Woodbury Heights, N.J.

[73] Assignee: Mobil Oil Corporation, New York, N.Y.

[22] Filed: Mar. 19, 1976

[21] Appl. No.: 668,765

[52] U.S. Cl. ..... 252/42.7; 44/75; 252/75; 260/137; 260/125

[51] Int. Cl.[2] ..... C10M 1/54

[58] Field of Search ..... 260/137, 608, 609 F, 260/125; 252/42.7, 75; 44/75

[56] References Cited

UNITED STATES PATENTS

| | | | |
|---|---|---|---|
| 2,409,687 | 10/1946 | Rogers et al. | 260/125 |
| 2,808,377 | 10/1957 | Davidson et al. | 260/608 |
| 2,916,454 | 12/1959 | Bradley et al. | 260/608 |
| 3,055,951 | 9/1962 | Ferm et al. | 260/137 |
| 3,367,867 | 2/1968 | Abbott et al. | 260/608 |
| 3,437,595 | 4/1969 | Coupland | 260/609 F |
| 3,464,970 | 9/1969 | Sakai et al. | 260/609 F |
| 3,725,381 | 4/1973 | Sakai et al. | 260/137 |
| 3,746,698 | 7/1973 | Hunt et al. | 260/137 |
| 3,801,507 | 4/1974 | Hendrickson et al. | 260/137 |

FOREIGN PATENTS OR APPLICATIONS

| | | | |
|---|---|---|---|
| 4,619 | 5/1971 | Japan | 260/137 |

*Primary Examiner*—Lewis Gotts
*Assistant Examiner*—D. R. Phillips
*Attorney, Agent, or Firm*—Charles A. Huggett; Raymond W. Barclay; Dennis P. Santini

[57] ABSTRACT

Neutral and overbased metal alkylphenate sulfides prepared by the steps of (1) reacting an alkylphenol sulfide with minor amounts of a basic material; (2) subjecting the reaction mixture of step (1) to steam sparging, carbonation, air sparging or a combination thereof; (3) reacting the product of step (2) with a metal oxide or hydroxide in the presence of an alcohol and carbon dioxide; and (4) subjecting the product of step (3) to steam sparging, carbonation, air sparging or a combination thereof, provide lower corrosiveness than conventional overbased metal alkylphenate sulfides. Fluid organic compositions such as, for example, oils and fuels which contain one or more of the present metal alkylphenate sulfides have excellent detergency and minimal corrosiveness with respect to metal surfaces.

19 Claims, No Drawings

METAL ALKYLPHENATE SULFIDES OF REDUCED CORROSIVENESS AND METHOD OF PREPARING SAME

BACKGROUND OF THE INVENTION

1. Field of the Invention

This invention relates to novel neutral or overbased metal containing additives and to a method for preparing them. Further, this invention relates to fluid organic compositions containing the above novel metal containing additives, said compositions exhibiting reduced corrosiveness.

2. Description of the Prior Art

U.S. Pat. No. 3,350,310 describes the preparation of overbased calcium alkylphenate sulfides by either first reacting a mixture of calcium oxide, methanol and carbon dioxide and reacting that reaction product with an alkylphenol sulfide or by reacting all these reactants together in the presence of a suitable solvent. U.S. Pat. No. 3,629,225 describes alkylphenol sulfides or alkaline earth metal salts thereof having reduced sulfur activity toward silver by treating the phenol or the said salt with a tervalent organic phosphorus compound, then removing the sulfur-phosphorus by-product. British Pat. No. 1,352,760 describes detergents prepared by reacting a mixture of alkylphenol sulfide and a Mannich base with alkaline earth metal to form bridging bonds between the two phenolic compounds. None of these patents discloses the improved products of the present invention, the method of preparing them or their use in fluid organic compositions having reduced corrosiveness to certain metals.

SUMMARY OF THE INVENTION

Novel alkaline earth metal alkylphenate sulfides are obtained by the novel method of reacting an alkylphenol sulfide with a basic material, sparging the reaction mixture with a gas or vapor or a mixture of gases simultaneously or sequentially at an elevated temperature, reacting the resulting alkylphenol sulfide with an alkaline earth metal oxide or hydroxide, alcohol and carbon dioxide and then further subjecting the resulting reaction product to carbon dioxide, steam and/or air.

DESCRIPTION OF SPECIFIC EMBODIMENTS

Alkylphenol sulfides used in this invention have the formula:

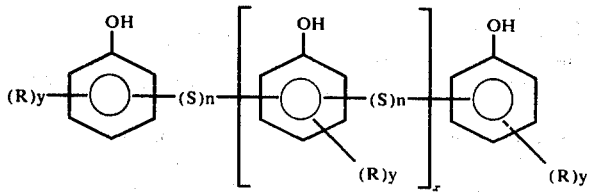

wherein $n$ is an integer of 2 to 4, $x$ is 0 or an integer of 1 to about 15, $y$ is an integer of 1 to 4 and may be the same or different and R is a hydrocarbyl group having from about 4 to about 50 carbon atoms. These alkylphenol sulfides may be prepared by known methods. The phenol may be alkylated by a reaction between olefins or alkyl halides and phenol, usually in the presence of an alkylation catalyst, such as Lewis acids, e.g.

aluminum chloride, boron trifluoride, hydrogen fluoride and the like. For example, U.S. Pat. Nos. 2,191,499 and 2,252,663 describe the preparation of wax phenol. The alkylphenols are then reacted with sulfur or a sulfur compound, such as sulfur dichloride, in any suitable ratio. U.S. Pat. Nos. 2,385,301, 2,366,874 and 2,362,289 disclose how to prepare sulfurized aromatic compounds.

The hydrocarbyl group R may be derived from butenes, pentenes, hexenes, decenes, dodecenes, octadecenes, eicosences, tricosenes, up to $C_{50}$ olefins, or their halides. Mixtures of different hydrocarbyl precursors may also be used, such as the wax mixtures, from about $C_{16}$ to about $C_{20}$. Aralkyl and cycloalkyl groups may also be present, such as benzyl and cyclohexyl. The term "alkylphenol sulfide" pertains to all such modifications as described above.

The alkylphenol sulfide produced by these known methods may be then further reacted with alkaline earth oxide and carbon dioxide to produce valuable overbased detergents, as indicated in U.S. Pat. No. 3,350,310. However, such additives, particularly if the alkylphenol sulfide is prepared from technical grade sulfur dichloride, which contains other sulfur chloride compounds, could not be used in a system in which metal corrosion, especially white metal corrosion, must be critically reduced. These other sulfur chloride compounds could lead to corrosive components in the final reaction mixture. Accordingly, it is the purpose of this invention to reduce the corrosiveness of overbased metal alkylphenate sulfide salts prepared from such alkylphenol sulfides.

In the preparation method of the present invention, the alkylphenol sulfide is first reacted with a basic material exemplified by an alkali or alkaline earth metal oxide or hydroxide or alcoholate; an amine, such as, for example $RNH_2$, RR'NH or RR'R''N, wherein R, R' and R'' are the same or different alkyl groups of from 1 to about 20 carbon atoms; an alkylene polyamine of the formula $H_2N—(C_mH_{2m}NH)_z—C_mH_{2m}NH_2$, wherein $m$ is an integer of 2 or 3, and $z$ is 0 or an integer of 1 to 10 or a cyclic amine, such as, for example pyridine. Thus, the oxides, hydroxides or $C_1$— to $C_{10}$-alcoholates of sodium, potassium, lithium, calcium, magnesium, strontium and the like are useful in this step. Methyl amine, ethyl amine, propyl amine, butyl amine, tert-butylamine, methylethylamine, trimethylamine, diethylamine and the like may also be used. Polyamines are preferred, such as ethylene diamine, propylene diamine, diethylene triamine, triethylene tetramine, tetraethylene pentamine and the like. The alkylene diamines, e.g. ethylene diamine, are particularly preferred. Cyclic amines, such as pyridine, piperazine and pyrimidine may also be used. Calcium oxide is another desirable basic material for use in this step of the preparation method. Only minor amounts of the basic material are mixed with the alkylphenol sulfide, usually from 0.05% to 10% by weight of the sulfide and preferably from about 1% to about 5% by weight of the sulfide. The amount of basic material used in this step of the preparation method is insufficient to provide significant amounts of neutralized phenate. The reaction temperature of this step is maintained at from about 100° C to about 250° C, preferably at from about 150° C to about 220° C. This temperature is maintained through step (2). Residual diluent or solvent which may be present with the phenate, such as those boiling at between 100° C and 200° C, do not affect the process or product therefrom. Examples of such diluents or solvents include aromatic hydrocarbons including benzene, monochlorobenzene, toluene, xylene; or a light solvent-refined mineral oil, such as paraffinic oil of about 100 SUS at 100° F, referred to herein as a process oil.

The reaction with basic material (step (1) of the preparation method) may be carried out for a period of time ranging from about 30 minutes to about 10 hours, more usually 30 minutes to 2 hours. Hydrogen sulfide evolves during this step of the preparation method.

In step (2) of the preparation method the reaction mixture from step (1) is sparged with steam, carbon dioxide, air or a combination thereof until hydrogen sulfide evolution becomes constant or nil while maintaining the temperature range of step (1). Steam of at least 212° F, or dry, superheated steam may be used for this purpose. Dry steam, at 275° F to 350° F, is preferred. Carbon dioxide is also useful in this step in place of steam, but preferably when the basic material is the metal base, such as calcium oxide. Another alternative of step (2) is air sparging to remove hydrogen sulfide or to pacify or oxidize the corrosive components, however this behavior is only theorized. Air is introduced until $H_2S$ evolution ceases. The most preferred procedure of this invention is to use either steam sparging or carbonation together with air sparging in step (2) in a sequential manner.

In step (3), to the resulting alkylphenol sulfide product from step (2) are added an alkaline earth metal oxide or hydroxide, a lower alkyl alcohol and a hydrocarbon solvent, which may be the same or different from that present in the first step, followed by the introduction of carbon dioxide. These materials may be added separately to produce the metal salt in situ (as above) or they may be premixed and prereacted (as in U.S. Pat. No. 3,350,310) and the resulting sol combined with the first reaction mixture.

Suitable metal reactants include the oxide or hydroxide of calcium, barium or magnesium. The alcohol may be a $C_1$ to $C_6$ alcohol, such as methanol, ethanol, butanol and the like. Most preferred of these two reactants are calcium oxide and methanol. Mixtures of other metal oxides and alcohols may be used in this aspect of the invention, if desired. The preferred solvent is an aromatic hydrocarbon, having a boiling point in the range of 100° C to 150° C, such as toluene, ethylbenzene, xylene or chlorobenzene. However, other inert organic solvents are useful.

The metal oxide or hydroxide, the alcohol and the solvent are added to the product of step (2) and the carbon dioxide is introduced into the reaction vessel below the surface of the reaction mass. The carbonation temperature of step (3) is usually maintained at from about 10° C to about 70° C, preferably from about 48° C to about 52° C. Total carbonation time may be from about 20 minutes to about 8 hours depending upon the rate of addition, the quantity of carbon dioxide introduced and the heat removal. Preferred carbonation time for this step is from about 20 minutes to about 90 minutes.

Overbased alkaline earth metal phenate products of this invention are produced by adding an excess of metal over the stoichiometric requirement so that the final metal content exceeds the stoichiometric balance. The resulting products, whether neutral or overbased, provide detergent, antioxidant and neutralizing properties to the fluid system in which they are used.

The amount of carbon dioxide added to the system in step (3) may range from about 0.3 to about 1.0 mole of carbon dioxide per mole of metal oxide or hydroxide added, preferably from about 0.4 to 0.8 mole and more preferably from about 0.5 to about 0.55 mole. The alcohol may be added in excess amount since excess alcohol not used up in reaction (including that released by decomposition of the sol) is removed by stripping. It is theorized that a carbonated metal alcoholate sol may be formed prior to or at the same time as the metal phenate formation. The solvent acts to provide contact between alkylphenol sulfide-base product and the metal-alcohol-$CO_2$ intermediate product.

Alternatively as indicated briefly above, the metal compound, alcohol and solvent may be separately carbonated prior to combination with the first reaction product. The carbonation is believed to produce a carbonated metal alcoholate sol and this sol may be added as a composite reactant.

The reaction mixture of step (3) is heated to remove volatile liquids, i.e. solvent and alcohol, which are substituted by adding a mineral oil to the product. The reaction mixture is filtered by any conventional means and the filtrate, if desired, may again be stripped to ensure complete removal of the lighter liquids.

In step (4) the filtrate is then sparged with additional carbon dioxide. The product may also be air sparged. The final "after-carbonation" or "after-sparging" step has been found to improve storage stability and to further decrease the corrosiveness of the final product in an oil formulation. The total carbon dioxide added in steps (3) and (4) is preferably within the aforestated mole ratio range of from about 0.3 to about 1.0 to the alkaline earth metal reactant.

The alkaline earth metal alkylphenate sulfides of this invention may be used in lubricating oil compositions, both mineral oil and synthetic oils, e.g. ester, hydrocarbon or polyester fluids. These products have utility in fuels, such as gasolines and fuel oil and kerosene based fuels. The fluid compositions may be used as marine Diesel lubricants and railroad engine lubricants, in automatic transmission fluids, diesel fuels, heat exchange fluids, gear oils as well as automotive lubricant oils and greases.

The following examples demonstrate the method of preparing the preferred products of this invention and are not intended to create any limitations on the scope of this invention.

EXAMPLE 1

1. In a suitable reactor was added 435 grams of a solution of 290 grams of dodecylphenol sulfide of 866 molecular weight and 8.9% sulfur (prepared from sufficient amounts of dodecylphenol and technical grade sulfur dichloride to provide a 6/5 phenol-sulfur ratio) and 145 grams of monochlorobenzene. To this mixture was added 100 grams of a solvent refined process mineral oil and the temperature of the mixture was raised to 165° C. About 55 grams of monochlorobenzene was distilled off.

2. The mixture was cooled to 120° C and 5 grams of 98% ethylene diamine was added, and the mixture was heated to reflux (160° C to 165° C) for 1 hour. $H_2S$ evolution began at 145° C then reached a maximum and tapered off. A water-cooled condenser was attached to the system and the reaction mixture was sparged with 320° F steam for 1 hour, then with air at 3.2 $ft^3$/hr for another hour, the reaction temperature being maintained at 160° C to 165° C.

3. To the resulting reaction mixture, after cooling, were added 450 ml of monochlorobenzene, 300 ml of methanol and 140 grams of calcium oxide. Then carbon dioxide was introduced subsurface at the rate of 400ml/minute for 61 to 65 minutes at 48° C to 55° C. The resulting weight gain was 56 grams. The resulting reaction mixture was stripped to 100° C and 170 grams of additional process oil was added; stripping was continued to 130° C.

4. Filter aid was added to the reaction mixture and the material was filtered into a clean reaction vessel. The filtrate was stripped to 160° C and sparged with carbon dioxide at 400 ml/minute for 30 minutes at 160° C. For an additional 30 minutes a vacuum of from 27 inches to 28 inches (gauge) was applied at 160° C. The reaction mass was then cooled to 85° C and 3.5 grams of a 20% solution of a polysilicone fluid defoamant was added with stirring.

The yield of product was 598 grams having the following analysis:

| | |
|---|---|
| Calcium | 9.06% |
| Sulfur | 3.68 |
| Nitrogen | 0.08 |
| Total Base Number (TBN) (using method described in U.S. 3,350,310) was 252 mg KOH/g | |

EXAMPLE 2

All of the steps of Example 1 were repeated, except that in step (2) 6 grams of ethylene diamine was used, followed by a 2-hour hold time at 160° C reflux; and in step (3) 144 grams of calcium oxide and 500 ml of monochlorobenzene were used. Of the resulting filtrate in step (4), one portion (2A) was stripped in the normal manner and a second portion (2B) was postcarbonated as in the rest of step (4).

The products had the following analysis:

| | 2A | 2B |
|---|---|---|
| % Calcium | 9.60 | 9.70 |
| % Sulfur | 3.51 | 3.48 |
| TBN | 265 | 266 |

EXAMPLE 3

Into a suitable reactor was added 2600 grams of the 2:1 weight solution of dodecylphenol sulfide and monochlorobenzene used in Example 1. This solution was mixed with 2000 ml of monochlorobenzene, 1800 ml of methanol and 860 grams of calcium oxide. Carbon dioxide (341 grams) was bubbled in subsurface at 48° C to 52° C. The methanol and part of the monochlorobenzene were removed by distillation, 1580 grams of process oil was added and the product was filtered. The remaining monochlorobenzene was removed by distillation.

The resulting product contained 8.84% calcium and 4.11% sulfur and had a TBN of 246.

EXAMPLE 4

The procedure of Example 1 was followed except that 10 grams of ethylene diamine was used. However, the steam and air sparging was omitted in step (2) and the $CO_2$ treatment after filtration in step (4) was omitted. The product contained 9.43% calcium and 3.41% sulfur and had a TBN of 272.

EXAMPLE 5

Into a suitable reactor was added 435 grams of the dodecylphenol sulfide solution of Example 1 and 100 grams of process oil. The mixture was steam sparged for 1 and ½ hours and air sparged for 1 hour at 160° C. The reactants and solvents used in step (3) of Example 1 were then added to the resulting product under the same conditions. The final product was filtered, leaving a product containing 8.93% of calcium and 4.0% sulfur and having a TBN of 243.

EXAMPLE 6

In a suitable reactor 395 grams of dodecylphenol sulfide/process oil (3 parts sulfide/1 part oil, the oil being "Promar No. 5" neutral solvent refined 100 SSU process oil) which had been subjected to treatment with 1.8% (based on weight of the dodecylphenol sulfide) of ethylene diamine, steam and air (for 1 hour and 1.5 hours, respectively) was overbased by adding thereto 550 cc of xylene, 275 cc of methanol and 130 grams of calcium oxide. Process oil (200 grams) was then added and the solvent distilled off.

Part of the resulting filtered product (6A) was subjected to 30 minutes of carbon dioxide at 160° C. The remaining portion (6B) was subjected to both carbon dioxide for 30 minutes at 160° C and air blowing for 1 hour at 180° C.

| Analysis | 6A | 6B |
|---|---|---|
| % Calcium | 8.95 | 8.93 |
| % Sulfur | 4.01 | 4.03 |
| TBN | 255 | 258 |

The following table represents the steps used in each of the above examples:

| Example | Process Steps |
|---|---|
| 1 | All steps followed |
| 2A | Step (4) omitted |
| 2B | All steps followed |
| 3 | Steps (1), (2) and (4) omitted |
| 4 | Steps (2) and (4) omitted |
| 5 | Steps (1) and (4) omitted |
| 6A | All steps followed |
| 6B | All steps followed |

EXAMPLE 7

In a suitable reactor, 363 grams of dodecylphenol sulfide (molecular weight 925, % sulfur 9.47) was mixed with 125 grams of process oil. To this mixture was added 17.5 grams of calcium oxide. This mixture was heated to 205° C and held for 1 and ½ hours. Following this period, the reaction mixture was air-sparged for 1 hour at 180° C.

To the resulting cooled mixture was added 550 ml of xylene, 275 ml of methanol and 115 grams of calcium oxide. Sixty grams of carbon dioxide was added subsurface at about 50° C. The methanol and part of the xylene were removed by distillation. Then 325 grams of process oil was added and the product was filtered through diatomaceous earth filter aid and the remaining xylene removed by distillation.

The resulting product was subjected to post carbonation adding carbon dioxide for 1 hour at 190° C and to air sparging for 4 and ¾ hours at 180° C.

EXAMPLE 8

In a suitable reactor, 390 grams of 3/1-weight mixture of dodecylphenol sulfide (molecular weight 934, % sulfur 9.56) and process oil was mixed with 15.0 grams of calcium oxide. This mixture was heated to 205° C and held for 1 and ½ hours during which period the mixture was sparged with carbon dioxide. Following this period, the reaction mixture was air-sparged for 2 and ½ hours at 180° C.

To the resulting cooled mixture was added 500 ml of xylene, 275 ml of methanol and 115 grams of calcium oxide. Fifty-eight grams of carbon dioxide was added subsurface at about 50° C. The methanol and part of the xylene were removed by distillation. Then 200 grams of process oil was added and the product was filtered and the remaining xylene removed by distillation.

The resulting product was subjected to post carbonation by adding carbon dioxide for 1 hour at 190° C and to air sparging for 4 hours at 180° C.

| Analysis: | |
|---|---|
| % Calcium | 8.83 |
| % Sulfur | 3.96 |
| TBN | 251 |

The neutral or overbased calcium phenate products of the above examples were individually blended into a fully formulated lubricating oil containing other additives with sufficient neutral or overbased calcium phenate sulfide to provide a 40-TBN oil blend and tested according to the following test descriptions.

MULTIPLE STRIP CORROSION TEST

The first test conducted was the "Corrosion Preventing Characteristics of Turbine Oil in The Presence of Water" test, generally described in Section 5 of ASTM Designation D665, except that the stirred oil sample is heated at 140° F for a period of 168 hours in the presence of five test specimen metals, i.e. steel, bronze, copper, lead babbit and tin babbit. Stirring is stopped at the end of the 168 hour period and the specimens are removed from the oil, allowed to drain and then gently washed with ASTM Precipitation Naphtha. After they are dry, the specimens are observed for the presence of rust, discoloration or deposit. Inspection is conducted without magnification and under light of about 60 foot candles.

In this test, the steel specimen is "rusted" if one or more rust spots or streaks are present. The copper, bronze and babbit specimens are considered to be discolored if there is any change from their original appearance.

The oil sample being tested is reported as having "passed" the test if there is no rusting or discoloration of specimens. It is reported as having "failed" the test if any rust or discoloration is observed.

MIRRLEES WHITE METAL CORROSION TEST

A test specimen (Glacier L1 white metal on a steel backing) is cut approximately 2 cms. long × 1 cm. wide × 1 cm. deep and a hole approximately 1/16 inch in diameter is drilled parallel to the white metal face. The Glacier L1 white metal has the following composition:

| | Specification | Typical Figure |
|---|---|---|
| Antimony % | 8.5 – 10 | 9.57 |
| Copper % | 4.0 – 4.5 | 4.23 |
| Lead % | 0.35 Max. | 0.35 |
| Iron % | — | 0.016 |
| Tin % | Balance | Balance |

The specimen then receives the following preparation on the white metal: It is polished on 1/0, 2/0, 3/0, 4/0 emery cloth wetted with white spirit, e.g. light kerosene. The emery cloth is stretched taut over a piece of plate glass to give a smooth surface. The specimen is turned through 90° between each successive polishing operation and polishing is continued until scratches from the previous grade of emery cloth have been removed.

The specimen is then micropolished on a Shandon Standard Polishing machine with a wheel speed of 550 rpm using a selvyt cloth (Grade A) impregnated with polishing alumina (Grade 5/20 — not more than 5% greater than 5 micron in size, about 20% finer than 1 micron and about 75% between 1 micron and 5 micron) wetted with distilled water. A final micropolish of the specimen is obtained on the polishing machine using a microcloth (Buehler Ltd.) impregnated with 1 micron diamond paste (Hypres 1W47) wetted with white spirit, e.g. light kerosene.

A 250 ml. beaker is filled approximately half full with test oil. The specimen is suspended (totally immersed in the oil) by string from a cross wire. The beaker is covered with a filter paper which is anchored by copper wire or by being crimped under the outside rim of the beaker. The beaker is then placed in a static air oven at 140° C for 100 hours. At the end of the test, the specimen is removed and rinsed with solvent (benzene).

After the completion of the test, specimens are examined under a microscope, using vertical illumination, at a magnification of 50× and 250× for the following evidence of attack:

a. Any oils which produce blackening of the surface of the white metal will be failed.
b. Any oils which do not blacken the surface of the white metal at the standard test temperature of 140° C but show incipient attack when viewed under the microscope, i.e. slight grain boundary attack and blackening of the cuboids, will receive a conditional pass.
c. Oils which give a clean specimen will be passed.

If a specimen appears equal to one not contacted with the oil in the test by visual inspection, the oil will be graded "boarderline pass".

Results of the tests indicated that the oil samples containing the products of Examples 1, 2B, 6A, 6B, 7 and 8 passed both the Multiple Strip Corrosion Test and the Mirrlees White Metal Corrosion Test. The oil samples containing the products of Examples 2A, 3, 4 and 5 failed one or the other or both tests. The results of the tests are presented in the following table.

TABLE OF TEST RESULTS

| Example | Multiple Strip Corrosion Test | Mirrlees White Metal Corrosion Test |
|---|---|---|
| 1 | Pass | Pass* |
| 2A | Fail | Pass |
| 2B | Pass | Pass |
| 3 | Fail | Fail |
| 4 | Fail | Pass* |
| 5 | Fail | Fail |
| 6A | Pass* | Pass |
| 6B | Pass | Pass |
| 7 | Pass | Pass |
| 8 | Pass | Pass |

*boarderline pass

It may thus be seen that omitting one or more of the critical steps of this invention: reaction of the phenol sulfide with basic material, vapor or gas sparging prior to the metalization reaction and following the metallization reaction with a post-treatment with steam, air and/or carbon dioxide, leads to products which when used in a lubricant are corrosive to sensitive metals, such as white metals.

While all of the above products evaluated are considered to be at least satisfactory detergents or dispersants for lubricants, the products of this invention have improved anticorrosion properties when compared with conventional overbased metal phenate sulfides.

What is claimed is:

1. A process for preparation of a metal alkylphenate sulfide which provides reduced corrosivity to metals comprising the steps of (1) reacting an alkylphenol sulfide with a minor amount of a basic material selected from the group consisting of an amine having the formula $RNH_2$, RR'NH or RR'R''N wherein R, R' and R'' are the same or different alkyl group of from 1 to about 20 carbon atoms, an alkylene polyamine having the formula $H_2N(C_mH_{2m}NH)_z—C_mH_{2m}NH_2$ wherein $m$ is an integer of 2 or 3 and $z$ is 0 or an integer of from 1 to 10 and a cyclic amine at a temperature of from about 100° C to about 250° C, (2) subjecting the reaction mixture of step (1) to steam sparging, carbonation, air sparging or a combination thereof at a temperature of from about 100° C to about 250° C, (3) reacting the product of step (2) with an alkaline earth metal oxide or hydroxide in the presence of an alcohol and carbon dioxide at a temperature of from about 10° C to about 70° C and (4) subjecting the product of step (3) to steam sparging, carbonation, air sparging or a combination thereof.

2. The process of claim 1 wherein said basic material of step (1) is an amine having the formula $RNH_2$, RR'NH or RR'R''N wherein R, R' and R'' are the same or different alkyl group of from 1 to about 20 carbon atoms.

3. The process of claim 1 wherein said basic material of step (1) is an alkylene polyamine having the formula $H_2N(C_mH_{2m}NH)_z—C_mH_{2m}NH_2$ wherein $m$ is an integer of 2 or 3 and $z$ is 0 or an integer of from 1 to 10.

4. The process of claim 3 wherein said alkylene polyamine is a diamine, a triamine, a tetramine or a pentamine.

5. The process of claim 4 wherein said alkylene polyamine is a diamine.

6. The process of claim 5 wherein said diamine is ethylene diamine.

7. The process of claim 1 wherein said basic material of step (1) is a cyclic amine.

8. The process of claim 7 wherein said cyclic amine is pyridine, piperazine or pyrimidine.

9. The process of claim 1 wherein said basic material of step (1) is present in step (1) in an amount of from 0.05 percent to 10 percent by weight of said alkylphenol sulfide.

10. The process of claim 9 wherein said basic material of step (1) is present in step (1) in an amount of from about 1 percent to about 5 percent by weight of said alkylphenol sulfide.

11. The process of claim 1 wherein said alkaline earth metal oxide or hydroxide of step (3) is calcium oxide or hydroxide, barium oxide or hydroxide or magnesium oxide or hydroxide.

12. The process of claim 11 wherein said alkaline earth metal oxide or hydroxide of step (3) is calcium oxide or hydroxide.

13. The process of claim 11 wherein said alcohol of step (3) contains 1 to 6 carbon atoms.

14. The process of claim 12 wherein said alcohol of step (3) is methanol.

15. The process of claim 1 wherein the carbon dioxide of step (3) is added within the range of from about 0.3 to about 1.0 mole of carbon dioxide per mole of alkaline earth metal oxide or hydroxide.

16. The process of claim 15 wherein the carbon dioxide of step (3) is added within the range of from about 0.4 to about 0.8 mole of carbon dioxide per mole of alkaline earth metal oxide or hydroxide.

17. The process of claim 16 wherein the carbon dioxide of step (3) is added within the range of from about 0.5 to about 0.55 mole of carbon dioxide per mole alkaline earth metal oxide or hydroxide.

18. The reaction product prepared by the process of claim 1.

19. The fluid organic composition comprising a major proportion of an organic lubricant, fuel or transmission fluid and a minor proportion sufficient to provide detergent, antioxidant or improved corrosion properties thereto of the reaction product of claim 18.

* * * * *

UNITED STATES PATENT AND TRADEMARK OFFICE

CERTIFICATE OF CORRECTION

PATENT NO. : 4,016,093
DATED : April 5, 1977
INVENTOR(S) : EMIL KOFT, JR.

It is certified that error appears in the above-identified patent and that said Letters Patent are hereby corrected as shown below:

Column 6, line 12 "9.43%" should read --9.34%--.

Signed and Sealed this nineteenth Day of July 1977

[SEAL]

*Attest:*

RUTH C. MASON
*Attesting Officer*

C. MARSHALL DANN
*Commissioner of Patents and Trademarks*